US009412298B2

(12) United States Patent
Nomura

(10) Patent No.: US 9,412,298 B2
(45) Date of Patent: Aug. 9, 2016

(54) LATCH CIRCUIT OF DISPLAY APPARATUS, DISPLAY APPARATUS, AND ELECTRONIC EQUIPMENT

(71) Applicant: SEIKO EPSON CORPORATION, Tokyo (JP)

(72) Inventor: Takeshi Nomura, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 258 days.

(21) Appl. No.: 14/175,437

(22) Filed: Feb. 7, 2014

(65) Prior Publication Data

US 2014/0285405 A1 Sep. 25, 2014

(30) Foreign Application Priority Data

Mar. 22, 2013 (JP) ..... 2013-059558

(51) Int. Cl.
*G09G 5/00* (2006.01)
*G09G 3/32* (2016.01)
*G09G 3/20* (2006.01)

(52) U.S. Cl.
CPC ..... *G09G 3/3233* (2013.01); *G09G 3/3291* (2013.01); *G09G 3/2003* (2013.01); *G09G 2300/0426* (2013.01); *G09G 2300/0819* (2013.01); *G09G 2300/0861* (2013.01); *G09G 2310/0297* (2013.01)

(58) Field of Classification Search
CPC ..... G09G 2310/0294; G09G 3/3233; G09G 3/3291; G09G 3/2003; G09G 2300/0426; G09G 2300/0819; G09G 2300/0861; G09G 2310/0297
USPC ..... 345/55, 98
See application file for complete search history.

(56) References Cited

U.S. PATENT DOCUMENTS 5,859,627 A * 1/1999 Hoshiya ..... G09G 3/3688 345/100
6,333,959 B1 * 12/2001 Lai ..... G11C 19/00 377/69
2002/0018029 A1 * 2/2002 Koyama ..... G09G 3/3275 345/39
2002/0158857 A1 * 10/2002 Iisaka ..... G09G 3/3688 345/204
2002/0167504 A1 * 11/2002 Matsumoto ..... G09G 3/3688 345/204
2003/0098860 A1 * 5/2003 Nakamura ..... G09G 3/3607 345/211
2004/0021426 A1 * 2/2004 Osame ..... G09G 3/2018 315/169.3

(Continued)

FOREIGN PATENT DOCUMENTS

JP 60064575 A * 4/1985 ..... H04N 1/40
JP A-2004-334105 11/2004

(Continued)

*Primary Examiner* — Kumar Patel
*Assistant Examiner* — Vinh Lam
(74) *Attorney, Agent, or Firm* — Oliff PLC

(57) ABSTRACT

A latch circuit for outputting data for M pixels present in one line on a display panel in a time-division manner for each pixel, in order to drive each pixel from among the M pixels based on N-bit data, includes M×N 1-bit latch circuits in which N 1-bit latch circuits are arranged in the column direction Y and M 1-bit latch circuits are arranged in the row direction X, each circuit latching 1-bit data. Each 1-bit latch circuit includes a data latch unit circuit that latches data corresponding to any one bit of the N bits at different timings for each row, a line latch unit circuit that simultaneously latches data from the data latch unit circuit in each row, and an output enable element that outputs data from the line latch unit circuit based on an enable signal for selecting any one column.

17 Claims, 12 Drawing Sheets

(56) References Cited

U.S. PATENT DOCUMENTS

2004/0046726 A1* 3/2004 Sako ..... G09G 3/3625 345/98
2004/0140970 A1* 7/2004 Morita ..... G09G 3/3611 345/204
2004/0150653 A1* 8/2004 Sakamaki ..... G09G 3/3611 345/592
2005/0001803 A1 1/2005 Morita et al.
2005/0017778 A1* 1/2005 Nogawa ..... G09G 3/2014 327/165
2005/0035981 A1* 2/2005 Ozaki ..... G09G 3/20 345/690
2006/0262059 A1* 11/2006 Hashimoto ..... G09G 3/3685 345/89
2007/0000971 A1 1/2007 Kumagai et al.
2007/0001886 A1 1/2007 Ito et al.
2007/0001982 A1 1/2007 Ito et al.
2007/0001983 A1 1/2007 Ito et al.
2007/0001984 A1 1/2007 Kumagai et al.
2007/0002188 A1 1/2007 Kumagai et al.
2007/0002509 A1 1/2007 Kumagai et al.
2007/0013634 A1 1/2007 Saiki et al.
2007/0013635 A1 1/2007 Ito et al.
2007/0013687 A1* 1/2007 Kodaira ..... G09G 3/20 345/204
2007/0013706 A1* 1/2007 Kodaira ..... G09G 3/3685 345/545
2007/0126689 A1* 6/2007 Ishii ..... G09G 3/2011 345/100
2007/0152946 A1* 7/2007 Endou ..... G09G 3/3688 345/100
2007/0296670 A1 12/2007 Morita et al.
2008/0088561 A1* 4/2008 Kawabe ..... G09G 3/2029 345/92
2008/0117234 A1* 5/2008 Yajima ..... G09G 3/2096 345/690
2009/0021501 A1* 1/2009 Umezaki ..... G09G 3/3208 345/205
2009/0212820 A1* 8/2009 Toriumi ..... G11C 8/10 326/105
2009/0219238 A1* 9/2009 Furuya ..... G09G 3/006 345/87
2009/0273388 A1* 11/2009 Yamashita ..... G09G 3/3648 327/416
2009/0273593 A1* 11/2009 Tonogai ..... G09G 3/3688 345/214
2009/0289886 A1* 11/2009 Sakai ..... G09G 3/3685 345/98
2010/0079422 A1* 4/2010 Shimodaira ..... G09G 3/344 345/205
2010/0220085 A1* 9/2010 Yen ..... G09G 3/20 345/211
2011/0128274 A1 6/2011 Kumagai et al.
2012/0019566 A1 1/2012 Ito et al.
2012/0120040 A1* 5/2012 Ogawa ..... G09G 3/3688 345/208
2012/0235983 A1* 9/2012 Sakamoto ..... G09G 3/3688 345/212
2013/0093653 A1 4/2013 Ota et al.
2014/0062995 A1* 3/2014 Kim ..... G09G 3/3688 345/214

FOREIGN PATENT DOCUMENTS

JP A-2007-243126 9/2007
JP 2009037690 A * 2/2009 ..... G11C 11/419
JP A-2013-88610 5/2013

* cited by examiner

LATCH CIRCUIT OF DISPLAY APPARATUS, DISPLAY APPARATUS, AND ELECTRONIC EQUIPMENT

CROSS-REFERENCE TO RELATED APPLICATIONS

This application claims priority to Japanese Patent Application No. 2013-059558 filed on Mar. 22, 2013.

The entire disclosure of Japanese Patent Application No. 2013-059558 is hereby incorporated herein by reference.

BACKGROUND

1. Technical Field

The present invention relates to a latch circuit of a display apparatus, a display apparatus, electronic equipment, and the like.

2. Related Art

For example, in matrix-type display apparatuses in which electro-optical elements such as liquid crystal elements or organic EL elements are arranged in a matrix, data sequentially transmitted via a serial interface is latched, for example, by a data latch circuit according to a shift clock from a shift register. Data for one line on a display panel is latched by the data latch circuit. When all data for one line is latched by the data latch circuit, the data for one line from the data latch circuit is simultaneously latched by a line latch circuit according to a horizontal synchronizing signal. In this manner, data for one line on the display panel is acquired (Refer to, for example, FIGS. 6 to 8 of JP-A-2004-334105).

According to a layout in the related art, a data latch circuit for sequentially latching data for one line and a line latch circuit for simultaneously latching data for one line are spaced away from each other. However, this layout is problematic in that an interconnect connecting these latch circuits becomes long, and tends to be affected by noise.

In recent years, for example, a driver including a latch circuit can be installed in a display panel such as an LCOS panel or an Si-OLED (organic light-emitting diode) panel in which a liquid crystal layer is formed on a silicon substrate. In this case, the latch circuit is formed in consideration of a pixel pitch of display pixels formed in the display panel. The reason for this is to make it easy to establish interconnection, by arranging a latch element for latching data that is to be supplied to one pixel, within the width of that pixel.

However, for example, in the case of a micro display panel used for a display such as an electronic viewfinder (EVF) or a head-mounted display (HMD), the pixel pitch is as small as, for example, 2.5 μm.

Furthermore, as the number of gradation bits in one pixel increases, the number of interconnects connecting data latch circuits and line latch circuits increases. Thus, the area occupied by the latch circuits increases.

Accordingly, there is an additional problem that it is difficult to arrange a latch element for latching data that is to be supplied to one pixel of a display panel, within the width of that pixel.

SUMMARY

An advantage of some aspects of the invention is to provide a latch circuit of a display apparatus, a display apparatus, and electronic equipment, in which the layout of the data latch circuit and the line latch circuit has been changed.

(1) An aspect of the invention is directed to a latch circuit of a display apparatus for outputting data for M pixels (M is an integer of 2 or more) present in one line on a display panel in a time-division manner for each pixel, in order to drive each pixel from among the M pixels based on N-bit data (N is an integer of 2 or more), including:

M×N 1-bit latch circuits in which N 1-bit latch circuits are arranged in a column direction and M 1-bit latch circuits are arranged in a row direction, each circuit latching 1bit data;

wherein each of the M×N 1-bit latch circuits includes a data latch unit circuit that latches data corresponding to any one bit of the N bits at different timings for each row, a line latch unit circuit that simultaneously latches data from the data latch unit circuit in each row, and an output enable element that outputs data from the line latch unit circuit based on an enable signal for selecting any one column.

With this aspect of the invention, each of M×N 1-bit latch circuits arranged in M columns×N rows includes a data latch unit circuit and a line latch unit circuit. In this manner, the data latch unit circuit and the line latch unit circuit can be arranged close to each other, and, thus, the interconnect between these latch unit circuits can be made as short as possible. Thus, the noise tolerance of output from the data latch unit circuit increases. Accordingly, for example, the situation can be avoided in which output from the data latch unit circuit is affected by noise immediately before line latching and erroneous data is line-latched. Even if the output interconnect from the line latch unit circuit is long, there is no adverse effect because data after line latching is stable until the next line latching.

Furthermore, N-bit data for driving one pixel is held by N 1-bit latch circuits per column. Furthermore, N-bit data for M pixels is held by M columns×N rows of 1-bit latch circuits. The 1-bit latch circuits can output data for M pixels in a time-division manner for each pixel, based on an enable signal for selecting any one column from among the M columns.

(2) In this case, it is preferable that the data latch unit circuit and the line latch unit circuit are arranged in the column direction in each of the M×N 1-bit latch circuits.

Since the data latch unit circuits and the line latch unit circuits are arranged in the column direction, the N 1-bit latch circuits per column can have a smaller width.

(3) In this case, it is preferable that the data latch unit circuit and the line latch unit circuit are arranged in the row direction in each of the M×N 1-bit latch circuits.

Also in this manner, the data latch unit circuit and the line latch unit circuit are arranged close to each other. Thus, the interconnect between these latch unit circuits can be made as short as possible.

(4) In this case, it is preferable that one output line is shared by the M 1-bit latch circuits arranged in the row direction, and N output lines from the N 1-bit latch circuits arranged in the column direction are arranged in the column direction in the upper layer of the region in which the M×N 1-bit latch circuits are formed.

In this manner, N output lines are sufficient for M×N 1-bit latch circuits, and, thus, the N output lines can be arranged with a certain margin in the upper layer of the region in which the M×N 1-bit latch circuits are formed. Accordingly, the arrangement pitch in the row direction of the N 1-bit circuits per column can be equal to or smaller than the arrangement pitch of the pixels in a display panel.

(5) In this case, it is preferable that the latch circuit further includes a first buffer circuit, at one end in the column direction, for shaping a first latch signal that is to be supplied to the data latch unit circuits, and an output line from the first buffer circuit is disposed in the column direction in the upper layer of the region in which the M×N 1-bit latch circuits are formed.

In this manner, a first latch signal shaped by the first buffer circuit can be supplied to a data latch unit circuit for each bit spaced away in the column direction. Moreover, the output line from the first buffer circuit can be disposed with a certain margin in the upper layer of the region in which the M×N 1-bit latch circuits are formed.

(6) In this case, it is preferable that the latch circuit further includes a second buffer circuit, at one end in the column direction, for shaping a second latch signal that is to be supplied to the line latch unit circuits, and an output line from the second buffer circuit is disposed in the column direction in the upper layer of the region in which the M×N 1-bit latch circuits are formed.

In this manner, a second latch signal shaped by the second buffer circuit can be supplied to a line latch unit circuit for each bit spaced away in the column direction. Moreover, the output line from the second buffer circuit can be disposed with a certain margin in the upper layer of the region in which the M×N 1-bit latch circuits are formed.

(7) Another aspect of the invention is directed to a display apparatus including the latch circuit according to any one of the above-described aspects. This display apparatus is a matrix-type display apparatus in which electro-optical elements such as liquid crystal elements or organic EL elements are arranged in the respective pixels.

(8) In this case, it is preferable that the latch circuit is installed in the display panel, and an arrangement pitch in the row direction of the M×N 1-bit latch circuits is equal to or smaller than an arrangement pitch in the row direction of the pixels.

In this manner, the width in the row direction of the display panel can be reduced, and the layout of the interconnects that supply data from the latch circuits to the pixels on the display panel can be easily realized.

(9) Another aspect of the invention is directed to electronic equipment including the display apparatus according to any one of the above-described aspects. Examples of the electronic equipment include an electronic viewfinder (EVF) and a head-mounted display (HMD).

BRIEF DESCRIPTION OF THE DRAWINGS

The invention will be described with reference to the accompanying drawings, wherein like numbers reference like elements.

DESCRIPTION OF EXEMPLARY EMBODIMENT

The following describes in detail a preferred embodiment of the invention. The embodiment set forth herein is not intended to unduly limit the scope of the invention defined in the claims, and not all of the structural features described in the embodiment are essential to the solution of the invention.

1. Display Apparatus (Electro-Optical Apparatus)

Figure 1:
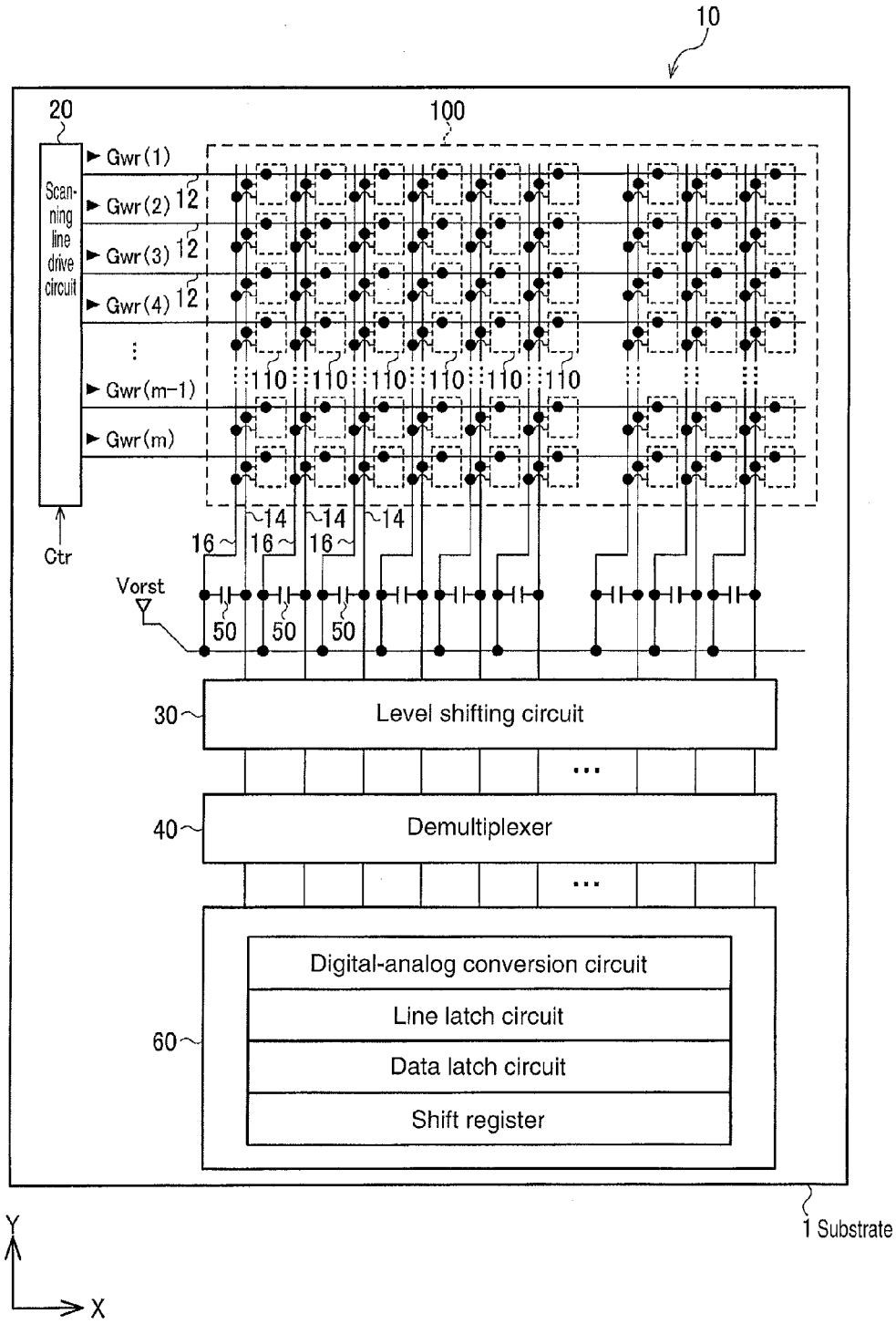
FIG. 1 is a diagram showing an example of a display apparatus of the invention.

FIG. 1 shows a display apparatus (electro-optical apparatus) 10 of this embodiment. The display apparatus 10 is configured such that a scanning line drive circuit 20, a demultiplexer 40, a level shifting circuit 30, a data line drive circuit 60, and a display portion 100 are formed on a semiconductor substrate such as a silicon substrate 1.

In the display portion 100, a plurality of scanning lines 12 are arranged in a row direction (horizontal direction) X, and a plurality of data lines 14 are arranged in a column direction (vertical direction) Y. A plurality of pixel circuits 110 each connected to one of the scanning lines 12 and one of the data lines 14 are arranged in a matrix.

In this embodiment, three pixel circuits 110 successively arranged along one scanning line 12 respectively correspond to R (red), G (green), and B (blue) pixels, and these three pixels represent one dot of a color image.

Figure 2:
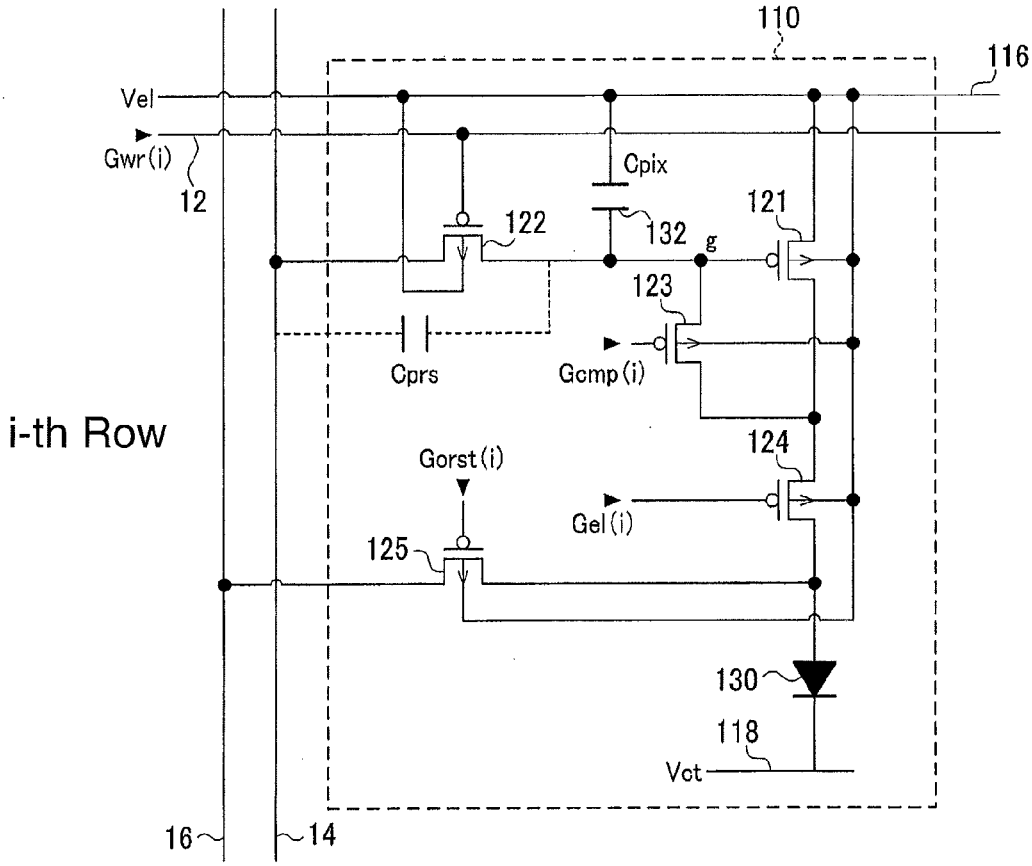
FIG. 2 is a circuit diagram of the pixel circuit shown in FIG. 1.

Hereinafter, an example of the pixel circuits 110 will be described. As shown in FIG. 2, the pixel circuit 110 in an i-th row includes P-type transistors 121 to 125, an OLED 130, and a holding capacitor 132. A scanning signal Gwr(i) and control signals Gel(i), Gcmp(i), and Gorst(i) are supplied to the pixel circuit 110.

The drive transistor 121 has a source that is connected to a feeder line 116 and a drain that is connected via the transistor 124 to the OLED 130, and controls a current to the OLED 130. The transistor 122 for writing a data line potential (gradation potential) has a gate that is connected to the scanning line 12, and a drain and a source one of which is connected to the data line 14 and the other of which is connected to the gate of the transistor 121. The holding capacitor 132 is connected between the gate line of the transistor 121 and the feeder line 116, and holds the voltage between the source and the gate of the transistor 121. A high potential Vel of the power source is fed to the feeder line 116. The cathode of the OLED 130 is used as a common electrode, and is set to a low potential Vct of the power source.

The transistor 123 has a gate that receives input of the control signal Gcmp(i), and causes a short-circuit between the gate and the drain of the transistor 121 in response to the control signal Gcmp(i). Accordingly, the transistor 121 forms a diode connection. As a result, the threshold voltage of the transistor 121 is held by the holding capacitor 132. This period is referred to as a compensation period during which a variation in the threshold of the transistor 121 is compensated for. Thus, the period during which the transistor 122 is on after the end of the compensation period is a write period during which a data potential is written to the gate of the transistor 121 and the holding capacitor 132.

The light-emitting control transistor 124 of the OLED 130 has a gate that receives input of the control signal Gel(i), and turns on and off connection between the drain of the transistor 121 and the anode of the OLED 130. The reset transistor 125 has a gate that receives input of the control signal Gorst(i), and supplies a reset potential Vorst, which is a potential of a feeder line 16, to the anode of the OLED 130 in response to the control signal Gorst(i). The difference between the reset potential Vorst and the common potential Vct is set to be lower than the light-emitting threshold of the OLED 130.

The scanning line drive circuit 20 shown in FIG. 1 supplies the scanning signal Gwr(i) to the scanning line 12 in the i-th row. Holding capacitors 50 are formed by arranging a dielectric between each data line 14 and each feeder line 16 extending in the column direction Y in FIG. 1. The level shifting circuit 30 shifts the level of a voltage with respect to the threshold voltage of the transistor 121 in accordance with the data signal (gradation level) supplied via the data line drive circuit 60 and the demultiplexer 40, and supplies the thus obtained voltage to the data line 14. As a method for the level shifting, it is conceivable to adopt the capacitance dividing method using the holding capacitor 50 and the holding capacitors inside the level shifting circuit 30. Note that, in this embodiment, it is not absolutely necessary to use the capacitance dividing drive method.

Figure 3:
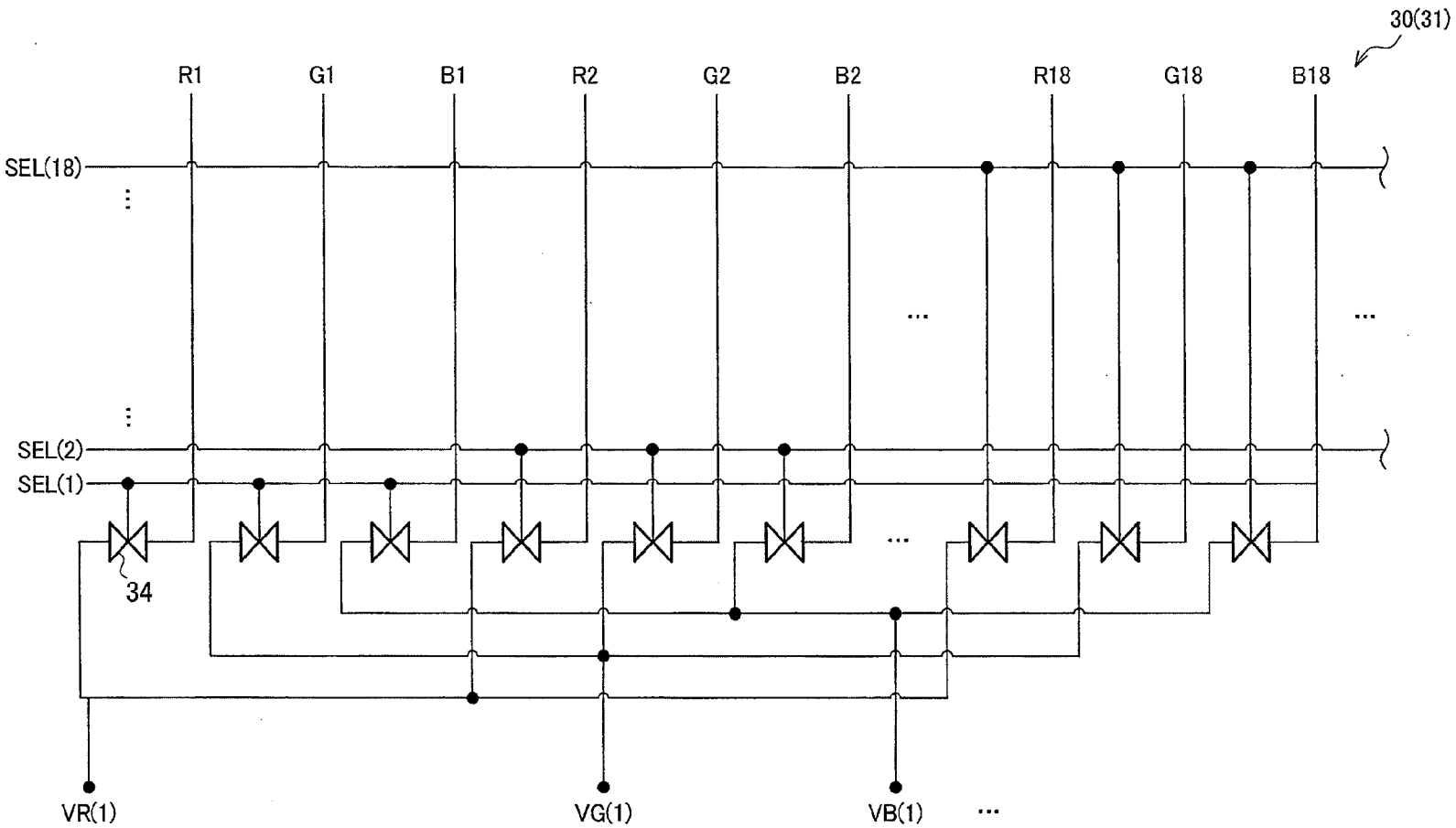
FIG. 3 is a circuit diagram showing part of the demultiplexer circuit shown in FIG. 1.

FIG. 3 shows an example of the demultiplexer 40. FIG. 3 shows a demultiplexer block 41 that switches and outputs the data potential in a time-division manner for each of RGB, to M (e.g., M=18)×3 (RGB) pixels (3×M=54 pixels) on one line (the i-th row) of the display portion 100 in FIG. 1. Demultiplexer blocks 41 as shown in FIG. 3 are provided in the number corresponding to (the total number of pixels in the row direction X)/54. The data potentials for 18 R pixels are input in a time-division manner from the data line drive circuit 60 to an input terminal VR(1) of the demultiplexer 40. In a similar manner, the data potentials for 18 G pixels and 18 B pixels are also input in a time-division manner from the data line drive circuit 60 to input terminals VG(1) and VB(1). Furthermore, 54 switches (transfer gates) 34 are provided between the input terminals VR(1), VG(1), and VB(1) and the 54 data lines. The 54 switches 34 are sequentially turned on three at a time in response to select signals SEL(1) to SEL (18). That is to say, when the select signal SEL(1) is active, the data potentials for 3 pixels (RGB) forming one dot are simultaneously written.

2. Data Line Drive Circuit Including Latch Circuits

As shown in FIG. 1, functional blocks of the data line drive circuit 60 include a shift register, a data latch circuit that sequentially latches data according to a clock from the shift register, a line latch circuit that simultaneously latches data from the data latch circuit, and a digital-analog conversion circuit that performs digital-analog conversion on data from the line latch circuit, and outputs the obtained data as a gradation voltage.

Figure 4:
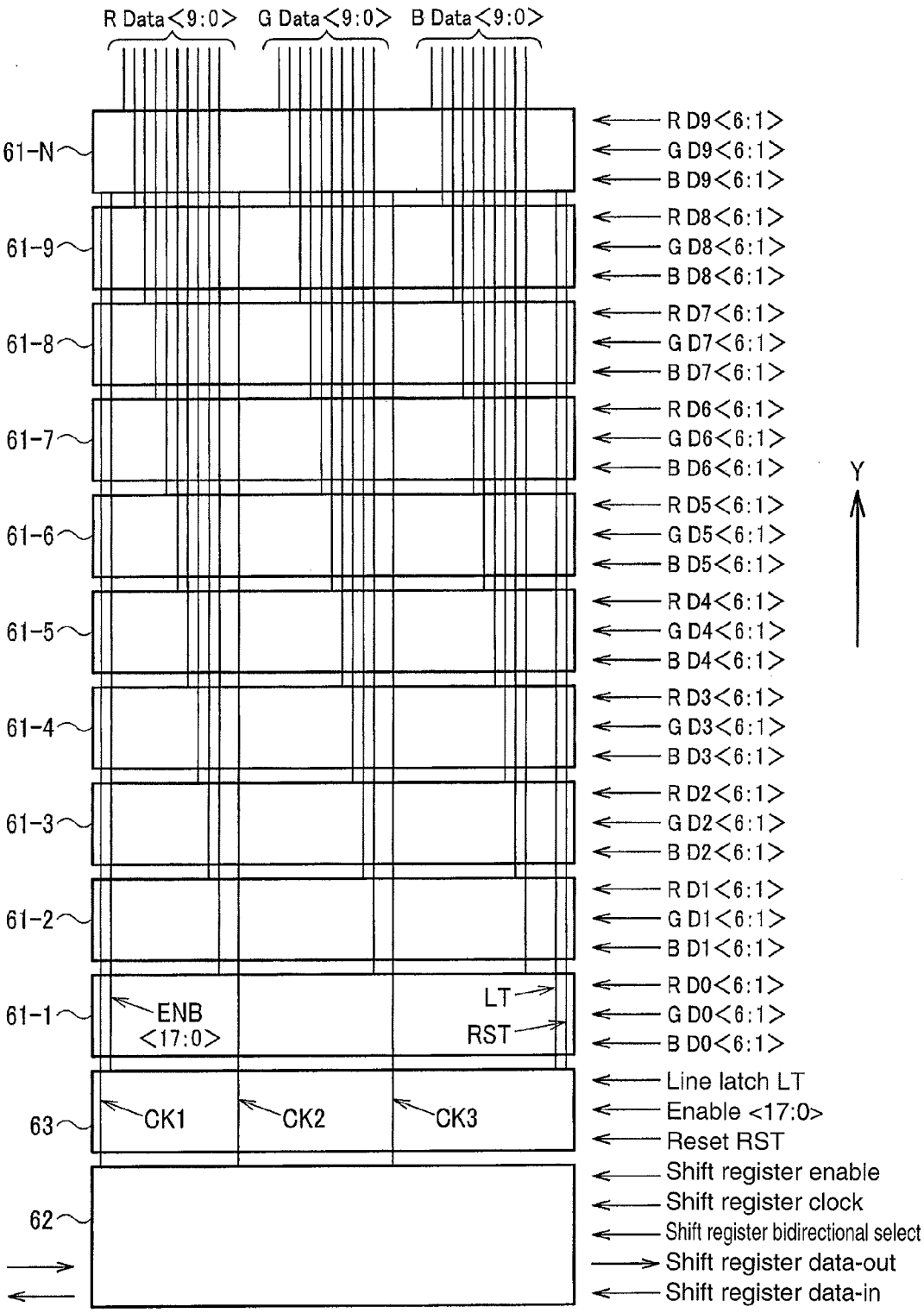
FIG. 4 is a layout diagram showing part of the latch circuits in the data line drive circuit shown in FIG. 1.
Figure 5:
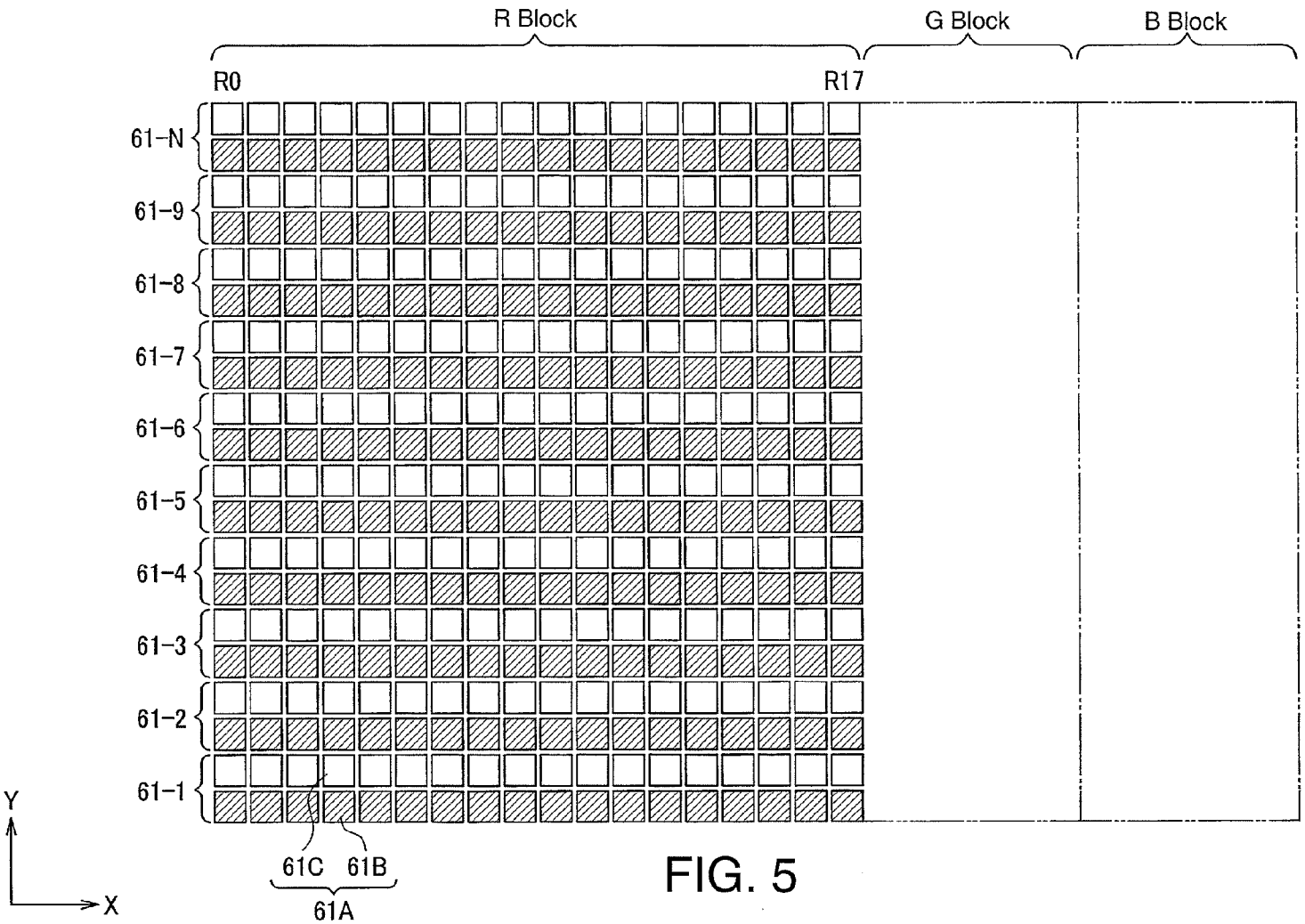
FIG. 5 is a diagram schematically showing a layout of the 1-bit latch circuits in the R block of the latch circuits shown in FIG. 4.
Figure 6:
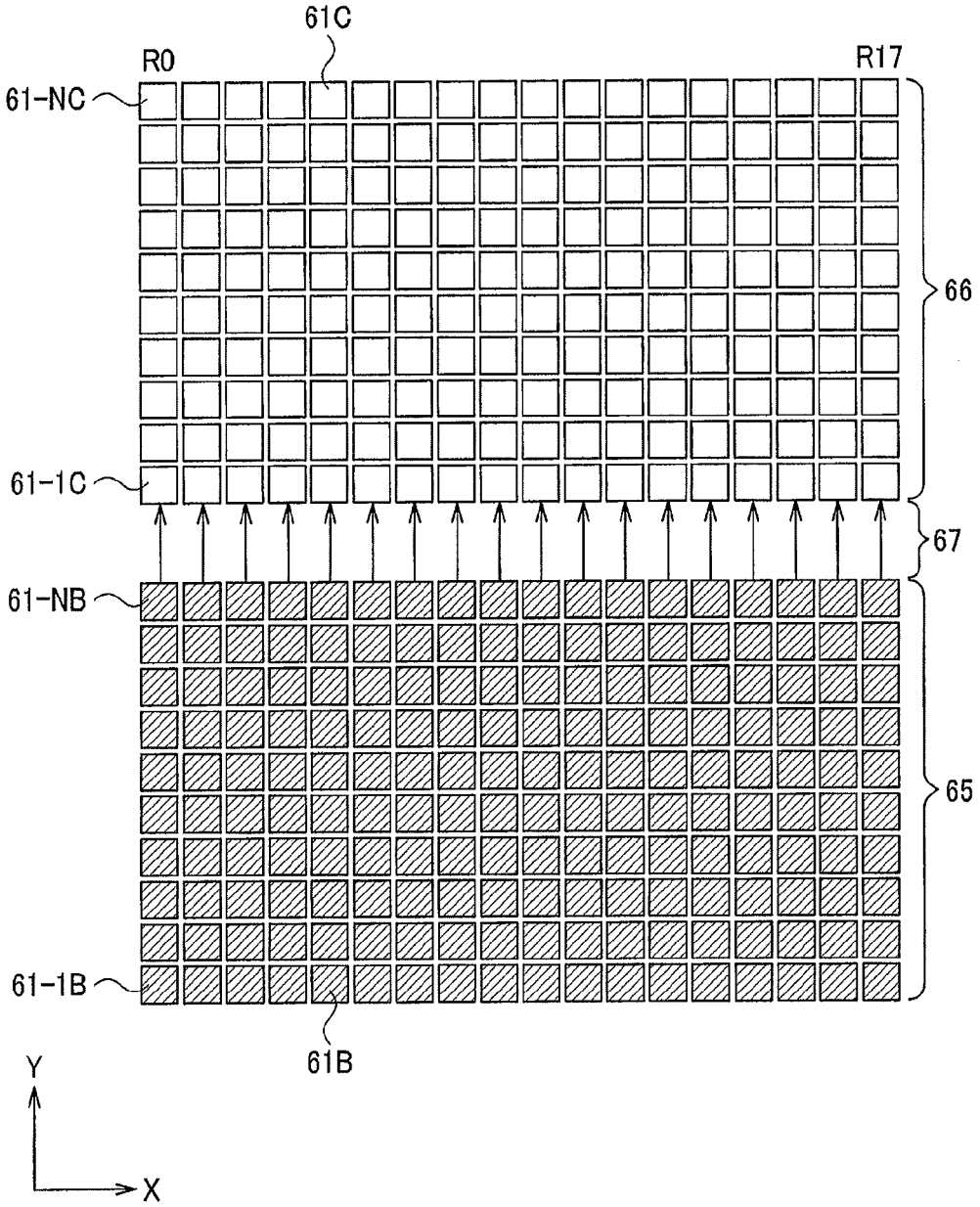
FIG. 6 is a diagram schematically showing a layout of an example for comparison with FIG. 5.

This embodiment is characterized by the layout of the data latch circuit and the line latch circuit in the data line drive circuit 60. Note that the data line drive circuit 60 is formed by stacking a multilayer film on a semiconductor substrate such as a silicon substrate. FIGS. 4 to 6 show the layout of the latch circuits. FIG. 4 shows blocks 61 in a latch circuit that latches N-bit (e.g., N=10-bit) gradation data for 54 pixels, which is to be supplied to part of the demultiplexer 40 shown in FIG. 3, as a 1-bit digital signal.

In this embodiment, if N=10 bits, N latch blocks 61-1 to 61-N (61-10) are provided in the column direction Y. Each of the latch blocks 61-1 to 61-N can latch signals corresponding to M (M=18)×3 (RGB)=54 bits. If the data for N=10 bits is taken as <D9:D0>, for example, the latch block 61-1 latches a least significant bit D0, and the latch block 61-10 latches a most significant bit D9. Furthermore, each of the latch blocks 61-1 to 61-N can sequentially data-latch input data, and also can line-latch all data. This aspect will be described later.

From each of the latch blocks 61-1 to 61-N, 1-bit gradation data is output for 1×3 (RGB) pixels selected from among 18×3 (RGB) pixels in response to the enable signal ENB<17:0>. Bit data output lines are arranged from the respective latch blocks 61-1 to 61-N so as to extend in the upper layer of the latch blocks on the downstream side in the column direction Y. Thus, the output lines are provided in the total number of N bits×3 (RGB) in the latch blocks 61, and R<9:0>, G<9:0>, and B<9:0> are simultaneously output.

As shown in FIG. 4, one end (upstream end) in the column direction Y is provided with a first buffer circuit 62 for shaping and outputting clocks CK1 to CK3 (first latch signals). The first buffer circuit 62 may include a shift register that generates the clocks CK1 to CK3. Output lines for outputting the clocks CK1 to CK3 from the first buffer circuit 62 are arranged in the upper layer of the latch blocks 61-1 to 61-N, and the clocks CK1 to CK3 are supplied to the latch blocks 61-1 to 61-N.

As shown in FIG. 4, one end (upstream end) in the column direction may be further provided with a second buffer circuit 63 for shaping a latch signal (second latch signal) LT input from the outside. Note that the positions of the first and the second buffer circuits 62 and 63 may be reversed in the column direction Y. The second buffer circuit 63 can shape an enable signal ENB<17:0> and a reset signal RST input from the outside. Output lines for outputting the latch signal LT, the enable signal ENB<17:0>, and the reset signal RST from the second buffer circuit 63 are arranged in the upper layer of the latch blocks 61-1 to 61-N, and the latch signal LT and the like are supplied to the latch blocks 61-1 to 61-N.

As shown in FIG. 5, each of the latch blocks 61-1 to 61-N is configured as a group of 1-bit latch circuits 61A that each latches 1-bit data. As shown in FIG. 5, the R block of the latch circuits 61 is configured as having N 1-bit latch circuits 61A (N=10) arranged in the column direction Y and M 1-bit latch circuits 61A (M=18) arranged in the row direction X, i.e., having M×N (=180) 1-bit latch circuits 61A in total. In a similar manner, each of the G block and the B block has M×N (=180) 1-bit latch circuits 61A.

Each of the M×N 1-bit latch circuits 61A includes a data latch unit circuit 61B that latches data corresponding to any one bit of the N bits at different timings for each row and a line latch unit circuit 61C that simultaneously latches data from the data latch unit circuit 61B in each row. In FIG. 5, the data latch unit circuits 61B are hatched such that they can be distinguished from the line latch unit circuits 61C. In this manner, the 1-bit latch circuits 61A can be configured by the data latch unit circuits 61B and the line latch unit circuits 61C that are adjacent to each other, for example, in the column direction Y.

FIG. 6 shows an example for comparison with the layout in FIG. 5. Typically, as in the functional blocks shown in the data line drive circuit 60 in FIG. 1, a data latch circuit 65 is disposed on the upstream side in the column direction Y in FIG. 6, and a line latch circuit 66 is disposed on the downstream side in the column direction Y. FIG. 6 shows the layout of the data latch unit circuits 61B and the line latch unit circuits 61C in the R block in this case illustrated as in FIG. 5. In FIG. 6, a row 61-1B in which the data latch unit circuits 61B for data-latching the least significant bit D0 are arranged is spaced away in the column direction from a row 61-1C in which the line latch unit circuits 61C for line-latching that least significant bit D0. That is to say, the data latch unit circuits 61B for data-latching other 9-bit data are arranged between the data latch unit circuit 61B and the line latch unit circuit 61C for latching the same bit data.

Comparison between the embodiment in FIG. 5 and the comparative example in FIG. 6 shows the following. According to this embodiment in FIG. 5, the 1-bit latch circuits 61A can be each configured by the data latch unit circuits 61B and the line latch unit circuits 61C that are adjacent to each other, for example, in the column direction Y. Thus, the data latch unit circuits 61B and the line latch unit circuits 61C can be connected with short interconnects. Thus, even if the 10 data latch unit circuits 61B that are arranged in the column direction Y have different latch timings, data from the data latch unit circuits 61B does not tend to be affected by noise from other bit data because the data is input via the short interconnects to the line latch unit circuits 61C. Thus, the possibility that erroneous data is latched by the line latch unit circuits 61C is small. On the other hand, in FIG. 6, the data latch unit circuits 61B and the line latch unit circuits 61C have to be connected with long interconnects. Accordingly, in FIG. 6, data from the data latch unit circuits 61B is transmitted through the long interconnects, and, thus, the data tends to be affected by noise from other bit data. Accordingly, in FIG. 6, erroneous data tends to be latched by the line latch unit circuits 61C. Note that, in FIG. 5, the length of the interconnects through which data line-latched by the line latch unit circuits 61C is output becomes longer as the data has a lower significance, as shown in FIG. 4. However, there is no adverse effect by the long interconnects because the line latching is simultaneously performed and the data after the line latching is stabilized.

In FIGS. 4 and 5, data is transferred in a time-division manner in 18 segments in response to the enable signal ENB<17:0>. Thus, the number of output lines is N for each of RGB blocks, i.e., N bits×3 (RGB)=3N (N=10)=30 for 3 RGB blocks shown in FIG. 4. In FIG. 6, if data is transferred without time-division into 18 segments, the number of output lines arranged in the row direction X in an interconnecting region 67 shown in FIG. 6 is M (M=18)×N (N=10)=180. In this case, the length in the X direction occupied by lines and spaces of the output lines arranged in the row direction X in the interconnecting region 67 is longer than the length in the X direction of the latch unit circuits 61B and 61C closely arranged in the X direction.

If the arrangement pitch in the X direction of the pixel circuits 110 shown in FIG. 1 is set to 2.5 μm, the width in the X direction of the pixel circuits 110 is 2.5 μm. With the layout in FIG. 5, the arrangement pitch in the X direction of the latch unit circuits 61B and 61C can be set to 2.5 μm or less. However, with the layout in FIG. 6, the arrangement pitch in the X direction of the latch unit circuits 61B and 61C is determined by the area of the output line formation region, and cannot be 2.5 μm or less.

Figure 7:
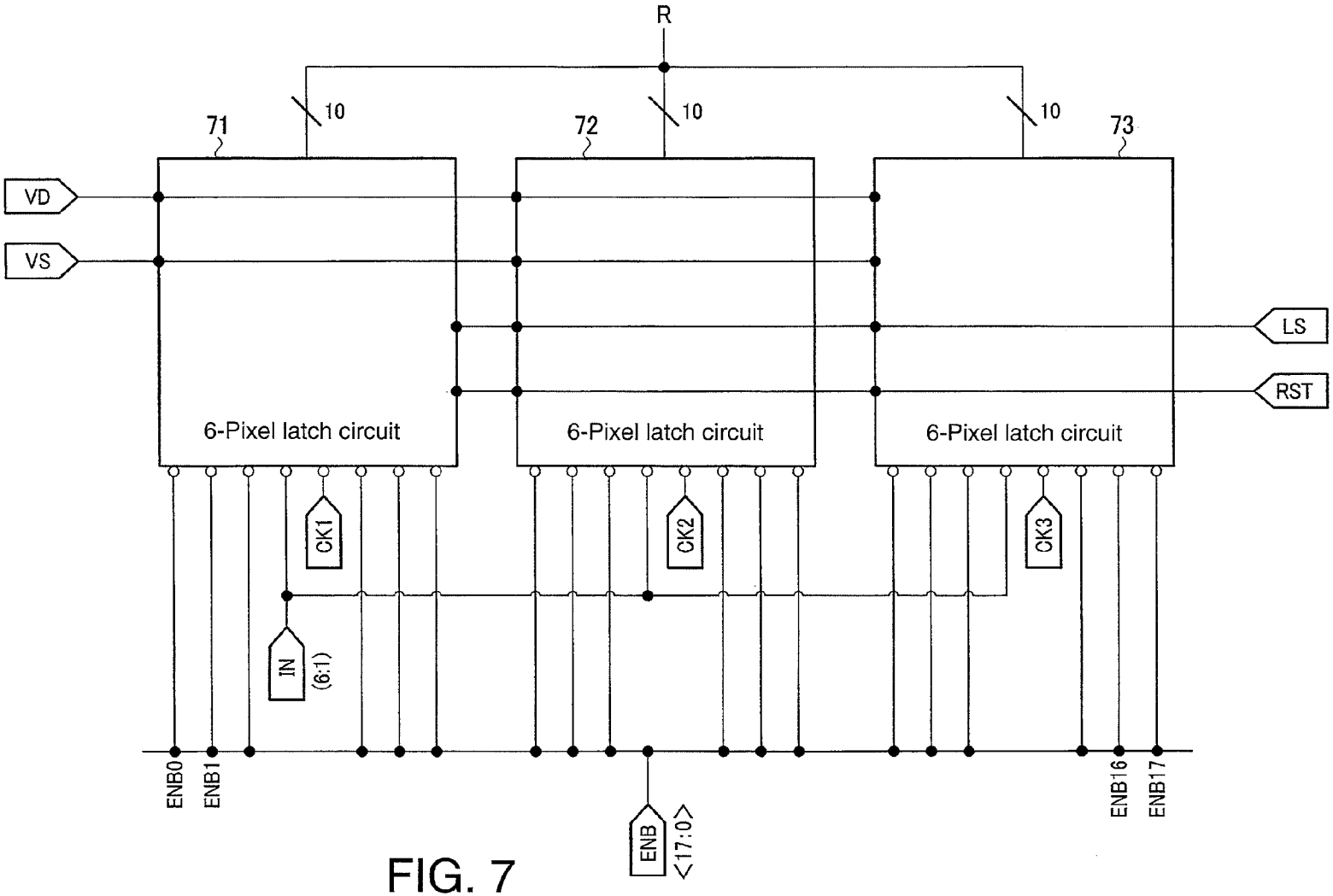
FIG. 7 is a diagram showing 3×6-bit circuits arranged in the R block of the latch circuits shown in FIG. 4.

FIG. 7 shows an example in which the R block of the latch circuits shown in FIG. 4 is configured, for example, by three 6-pixel latch circuits 71, 72, and 73. The 6-pixel latch circuit 71 sequentially data-latches the data IN<6:1> for six pixels in synchronization with the first clock CK1 (first latch signal) from the first buffer circuit 62 in FIG. 4. The 6-pixel latch circuit 72 sequentially data-latches the data IN<6:1> for six pixels, at a timing different from that for the 6-pixel latch circuit 71, in synchronization with the second clock CK2 (first latch signal) from the first buffer circuit 62 in FIG. 4. The 6-pixel latch circuit 73 sequentially data-latches the data IN<6:1> for six pixels, at a timing different from those for the 6-pixel latch circuits 71 and 72, in synchronization with the third clock CK3 (first latch signal) from the first buffer circuit 62 in FIG. 4.

Then, the three 6-pixel latch circuits 71 to 73 simultaneously line-latch R data for 18 pixels in synchronization with the latch signal LT (second latch timing signal) from the second buffer circuit 63 in FIG. 4. Subsequently, in response to the enable signal ENB<17:0>, the R data is time-divided into 18 segments and is output as N-bit (N=10) data per pixel.

Figure 8:
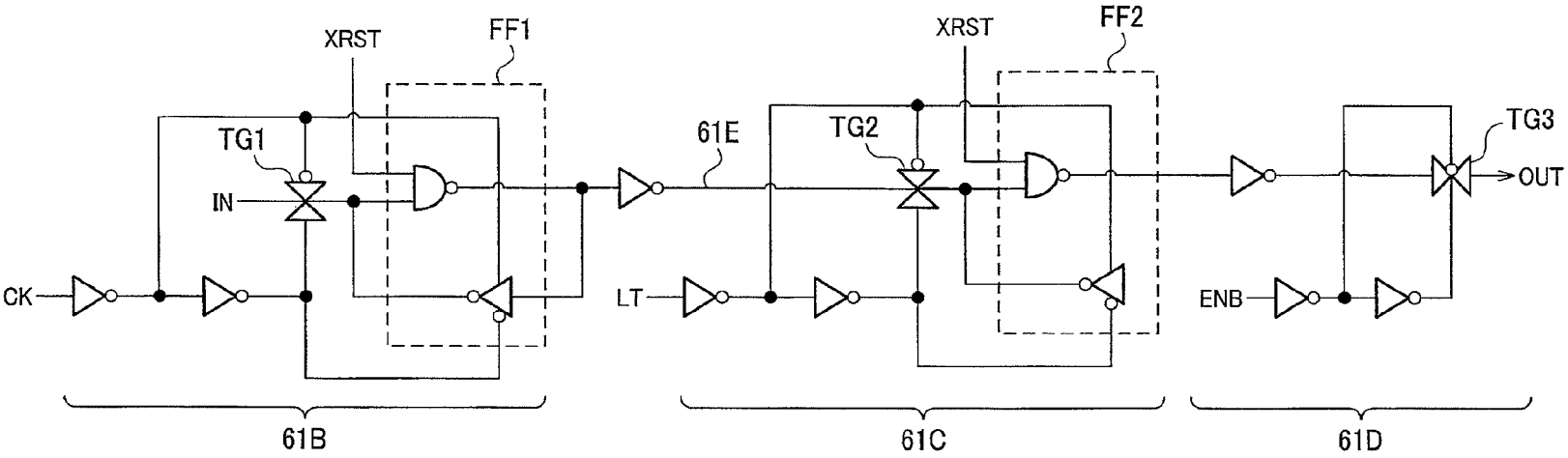
FIG. 8 is a circuit diagram showing an example of the data latch unit circuit, the line latch unit circuit, and the output enable element forming a 1-bit latch circuit.

FIG. 8 shows an example of the data latch unit circuit 61B, the line latch unit circuit 61C, and an output enable element 61D. In the data latch unit circuit 61B, when an inverse reset signal XRST is turned to High, 1-bit data IN is held via a transfer gate TG1 by a data hold circuit FF1 in synchronization with the clock CK. In the line latch unit circuit 61C, when the inverse reset signal XRST is turned to High, the 1-bit data IN output from the hold circuit FF1 is held via a transfer gate TG2 by a data hold circuit FF2 in synchronization with the latch signal LT. In the output enable element 61D, when the enable signal ENB is turned to High, the 1-bit data from the data hold circuit FF2 is output via a transfer gate TG3. When the inverse reset signal XRST is turned to Low, the data hold circuits FF1 and FF2 are reset.

As is clear from FIG. 8, an interconnect 61E connecting the data latch unit circuit 61B and the line latch unit circuit 61C can be made short, and, thus, the adverse effect by noise can be reduced.

3. Electronic Equipment

Figure 9:
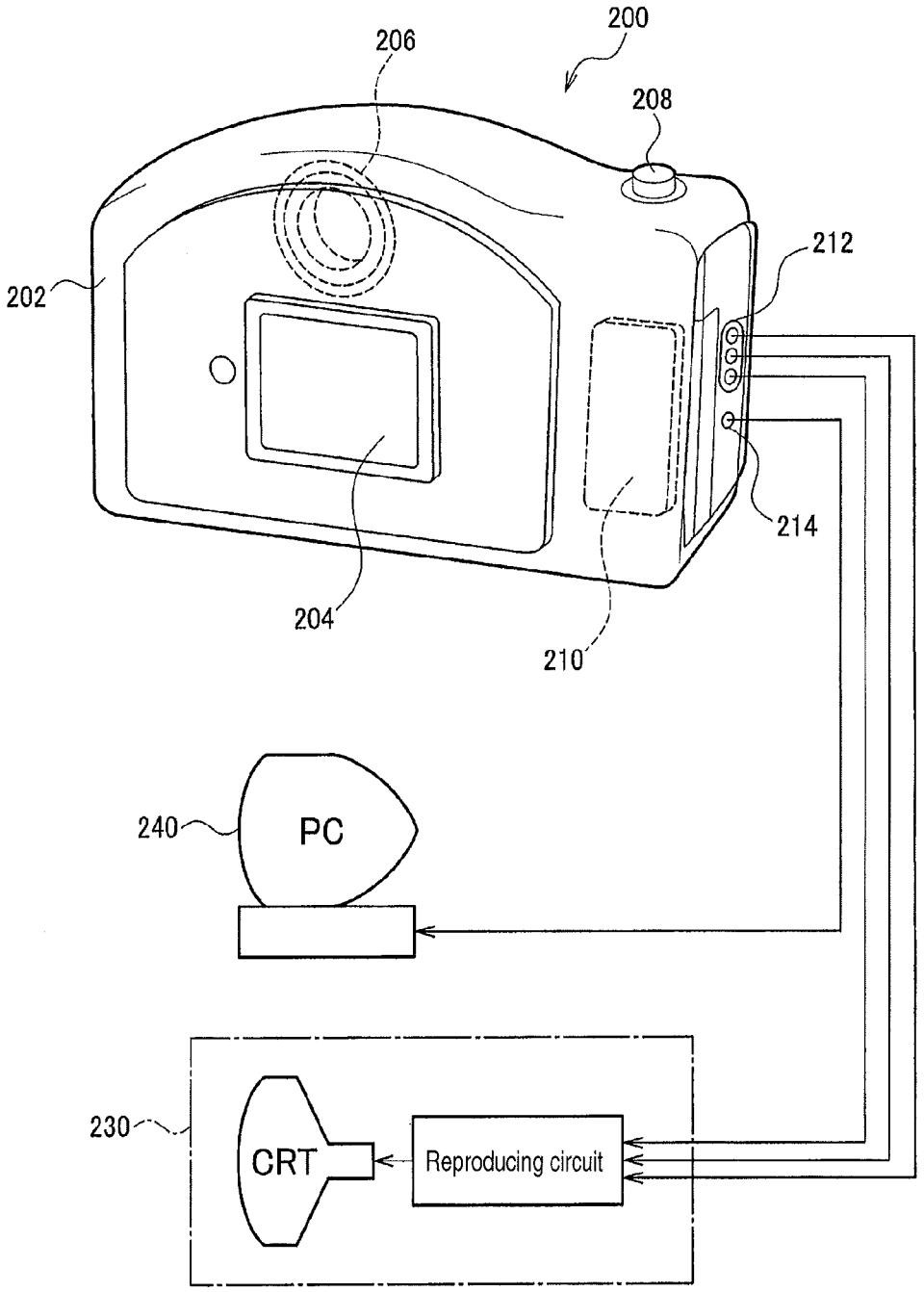
FIG. 9 is a view showing a digital still camera, which is an example of electronic equipment.

FIG. 9 is a perspective view showing the configuration of a digital still camera 200, wherein connection to external equipment is also schematically shown. A rear face of a casing 202 of the digital still camera 200 is provided with a display apparatus 204 employing the above-described display apparatus 10 using organic EL elements. The display apparatus 204 displays images based on imaging signals from a CCD (charge coupled device). Accordingly, the display apparatus 204 functions as an electronic viewfinder that displays a subject. The viewing side (the back face side in FIG. 9) of the casing 202 is provided with a light-receiving unit 206 including an optical lens, a CCD, and the like.

When the user views an image of the subject displayed on the display apparatus 204 and pushes a shutter button 208, the imaging signal of the CCD at that time is transferred and stored in a memory of a circuit board 210.

In the digital still camera 200, a side of the casing 202 is provided with video signal output terminals 212 and a data communication input/output terminal 214. A TV monitor 230 is connected to the video signal output terminals 212, and a personal computer 440 is connected to the data communication input/output terminal 214, as necessary. Furthermore, with a predetermined operation, the imaging signal stored in the memory of the circuit board 210 is output to the TV monitor 230 or the personal computer 240.

Figure 10:
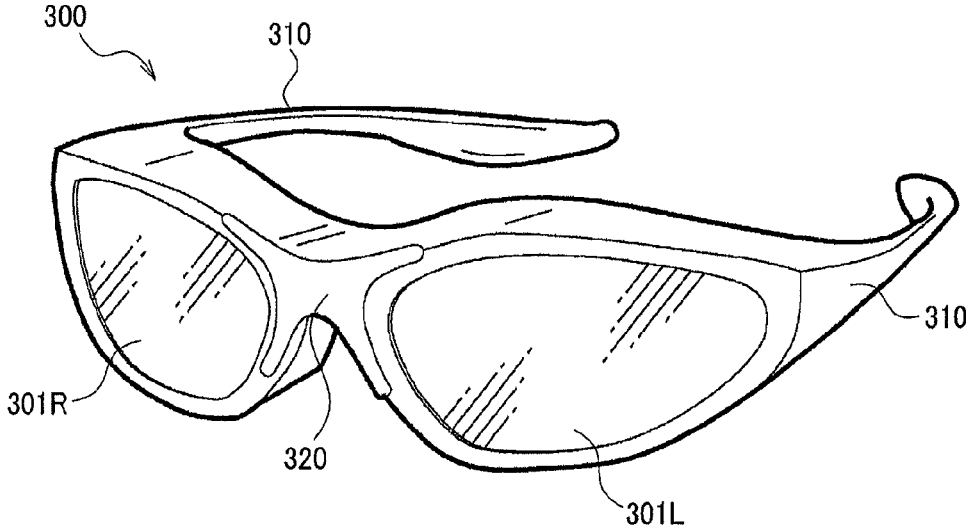
FIG. 10 is an external view of a head-mounted display, which is another example of electronic equipment.
Figure 11:
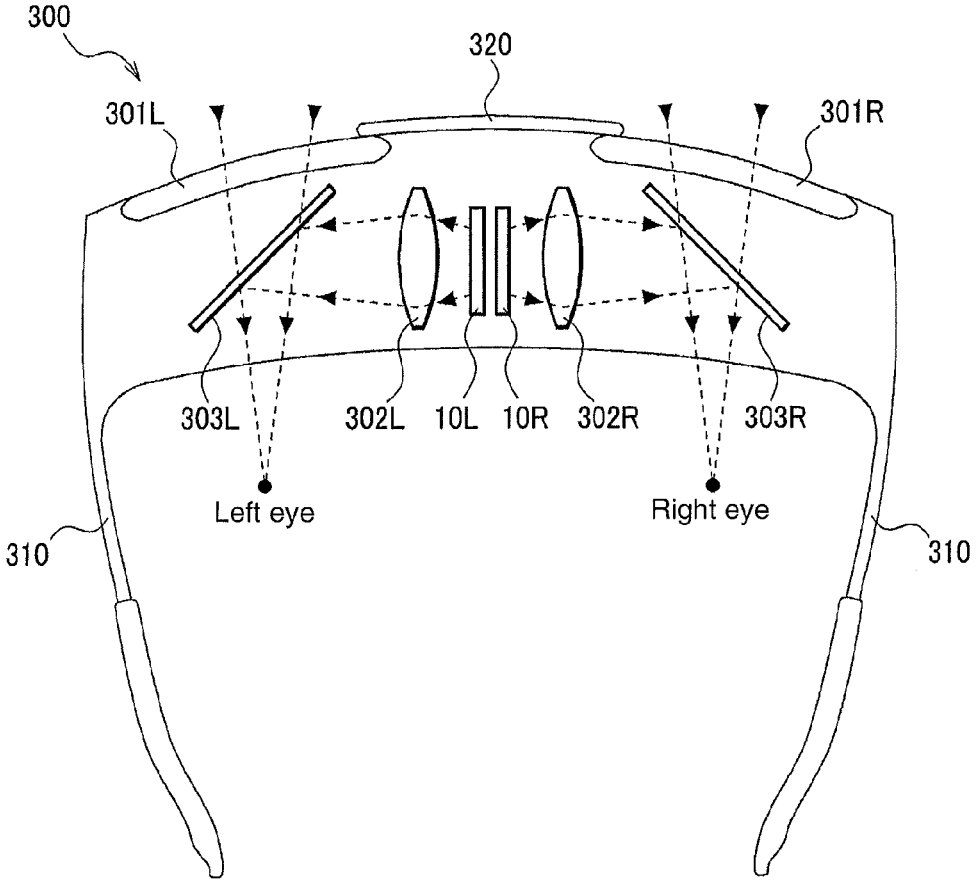
FIG. 11 is a view showing a display apparatus and an optical system of the head-mounted display.

FIGS. 10 and 11 show a head-mounted display 300. The head-mounted display 300 has temples 310, a bridge 320, and lenses 301L and 301R, as in the case of glasses. A display apparatus 10L for the left eye and a display apparatus 10R for the right eye are provided inside the bridge 320. The display apparatus 10 shown in FIG. 1 can be used as the display apparatuses 10L and 10R.

Images displayed on the display apparatuses 10L and 10R are transmitted via optical lenses 302L and 302R and half mirrors 303L and 303R and are incident on both eyes. An image for the left eye and an image for the right eye with parallax can realize 3D display. Note that the half mirrors 303L and 303R are light-transmissive, and, thus, they do not disturb the visual field of the user.

Although this embodiment has been described in detail, a person skilled in the art will easily understand that various modifications of the invention are possible without substantially departing from new matters and advantageous effects thereof. Accordingly, all of such modified examples are included in the scope of the invention. For example, terms that appear at least once in this specification or drawings can be replaced by different terms. Furthermore, the configurations and operations of the latch circuits, the display apparatuses, the electronic equipment, and the like are not limited to those described in this embodiment, and various modifications are possible.

Figure 12:
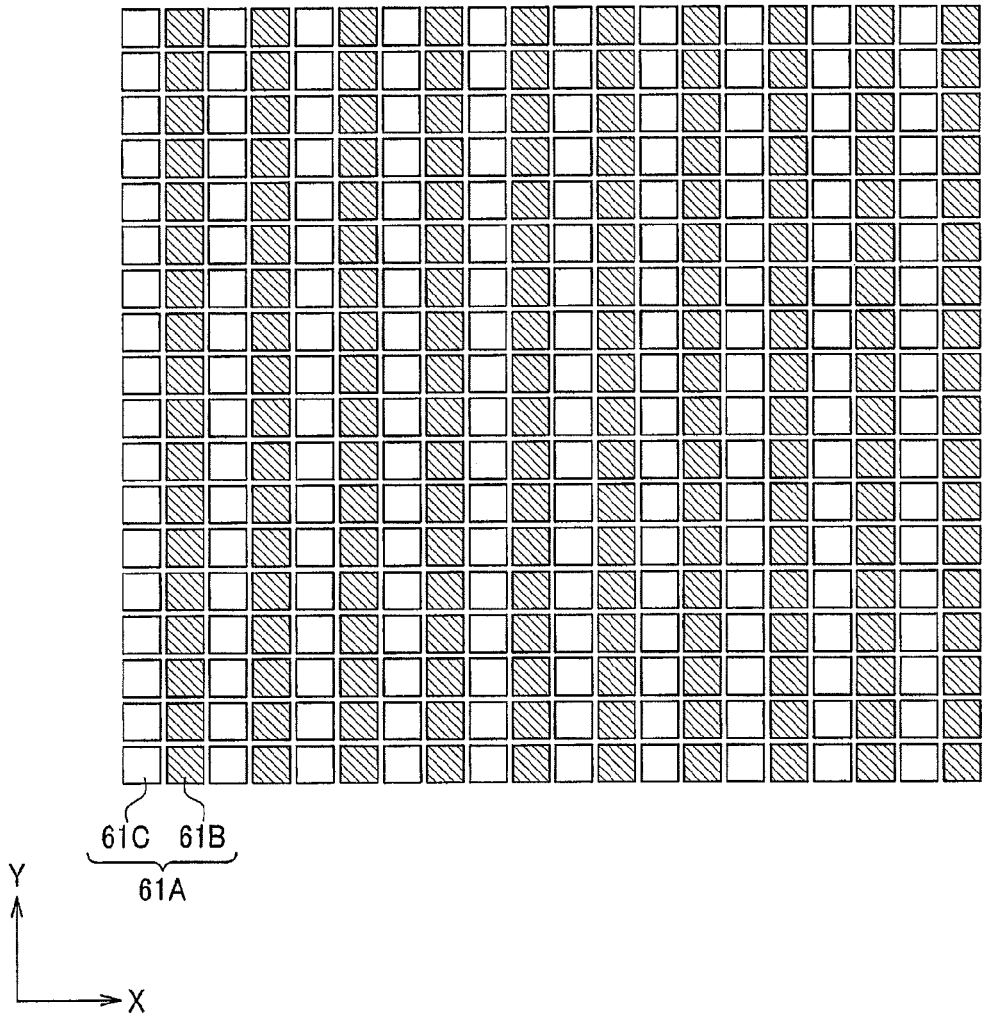
FIG. 12 is a diagram schematically showing another layout of the 1-bit latch circuits in the R block of the latch circuits shown in FIG. 4.
Figure 13:
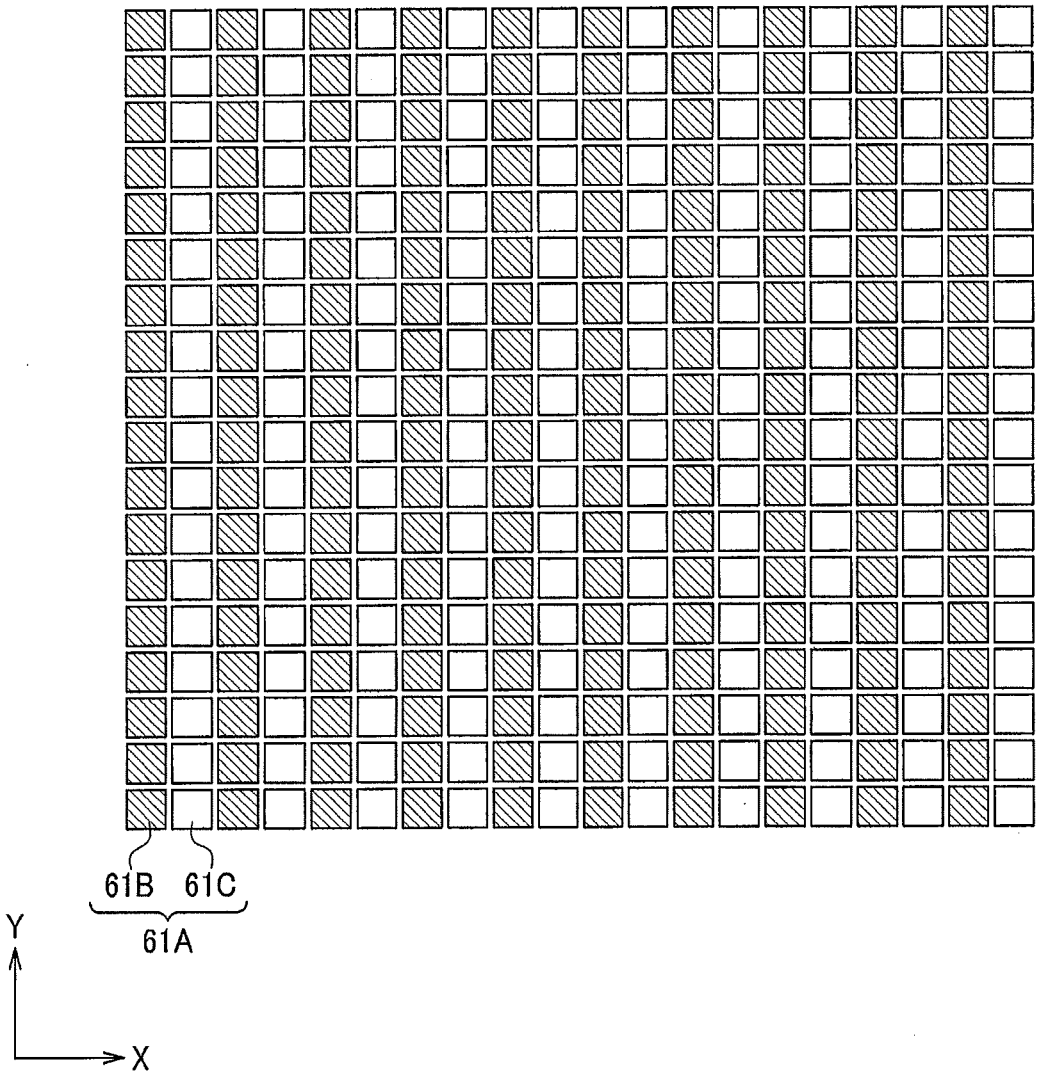
FIG. 13 is a diagram schematically showing another layout of the 1-bit latch circuits in the R block of the latch circuits shown in FIG. 4.

For example, the data latch unit circuits 61B and the line latch unit circuits 61C forming the 1-bit latch circuits 61A may not be adjacent to each other in the column direction Y as shown in FIG. 5. The data latch unit circuits 61B and the line latch unit circuits 61C may be adjacent to each other in the row direction X as shown in FIGS. 12 and 13. In this case, the same effects as those in FIG. 5 can be achieved except that the arrangement pitch in the row direction X of the 1-bit latch circuits 61A is larger than that in FIG. 5.

What is claimed is:

1. A latch circuit of a display apparatus for outputting data for M pixels (M is an integer of 2 or more) present in one line on a display panel in a time-division manner for each pixel, in order to drive each pixel from among the M pixels based on N-bit data (N is an integer of 2 or more), comprising:

M×N 1-bit latch circuits in which N 1-bit latch circuits are arranged in a column direction and M1-bit latch circuits are arranged in a row direction, each circuit latching 1-bit data;

wherein each of the M×N 1-bit latch circuits includes a data latch unit circuit that latches data corresponding to any one bit of the N bits at different timings for each row, a line latch unit circuit that simultaneously latches data from the data latch unit circuit in each row, and an output enable element that outputs data from the line latch unit circuit based on an enable signal for selecting any one column, and wherein one output line is shared by the M1-bit latch circuits arranged in the row direction, and N output lines from the N 1-bit latch circuits arranged in the column direction are arranged in the column direction in an upper layer of a region in which the M×N 1-bit latch circuits are formed.

2. The latch circuit of the display apparatus according to claim 1, wherein the data latch unit circuit and the line latch unit circuit are arranged in the column direction in each of the M×N 1-bit latch circuits.

3. The latch circuit of the display apparatus according to claim 1, wherein the data latch unit circuit and the line latch unit circuit are arranged in the row direction in each of the M×N 1-bit latch circuits.

4. The latch circuit of the display apparatus according to claim 1, further comprising: a first buffer circuit, at one end in the column direction, for shaping a first latch signal that is to be supplied to the data latch unit circuits;

wherein an output line from the first buffer circuit is disposed in the column direction in the upper layer of the region in which the M×N 1-bit latch circuits are formed.

5. The latch circuit of the display apparatus according to claim 1, further comprising:

a second buffer circuit, at one end in the column direction, for shaping a second latch signal that is to be supplied to the line latch unit circuits;

wherein an output line from the second buffer circuit is disposed in the column direction in the upper layer of the region in which the M×N 1-bit latch circuits are formed.

6. A display apparatus, comprising the latch circuit according to claim 1.

7. A display apparatus, comprising the latch circuit according to claim 2.

8. A display apparatus, comprising the latch circuit according to claim 3.

9. A display apparatus, comprising the latch circuit according to claim 4.

10. A display apparatus, comprising the latch circuit according to claim 5.

11. The display apparatus according to claim 6, wherein the latch circuit is installed in the display panel, and an arrangement pitch in the row direction of the M×N 1-bit latch circuits is equal to or smaller than an arrangement pitch in the row direction of the pixels.

12. Electronic equipment, comprising the display apparatus according to claim 6.

13. Electronic equipment, comprising the display apparatus according to claim 7.

14. Electronic equipment, comprising the display apparatus according to claim 8.

15. Electronic equipment, comprising the display apparatus according to claim 9.

16. Electronic equipment, comprising the display apparatus according to claim 10.

17. Electronic equipment, comprising the display apparatus according to claim 11.

* * * * *